US005213136A

United States Patent [19]

Thorp et al.

[11] Patent Number: 5,213,136

[45] Date of Patent: May 25, 1993

[54] SELECTION SWITCH FOR FLUID POWER MOTORS

[75] Inventors: Phil D. Thorp, Bryan; Stephen F. Sims, Ney, both of Ohio

[73] Assignee: The Aro Corporation, Bryan, Ohio

[21] Appl. No.: 825,758

[22] Filed: Jan. 27, 1992

Related U.S. Application Data

[63] Continuation of Ser. No. 615,371, Nov. 19, 1990, abandoned.

[51] Int. Cl.[5] ..... F15B 13/01

[52] U.S. Cl. ..... 137/625.68; 74/527; 173/169; 251/111

[58] Field of Search ..... 74/527; 173/169; 137/625.68; 251/111

[56] References Cited

U.S. PATENT DOCUMENTS

| | | | |
|---|---|---|---|
| 813,110 | 2/1906 | Norling | 251/111 |
| 3,083,944 | 4/1963 | Doeden | 173/169 X |
| 3,298,284 | 1/1967 | Alexander | 173/169 X |
| 3,357,677 | 12/1967 | Tasker | 251/111 X |
| 3,510,099 | 5/1970 | Crump | 173/169 X |
| 3,535,783 | 10/1970 | Thatcher | 251/114 X |
| 3,826,156 | 7/1974 | Dornaus | 74/527 |
| 3,861,476 | 1/1975 | Borsum | 251/111 X |
| 3,989,113 | 11/1976 | Spring et al. | 137/625.69 X |
| 4,416,338 | 11/1983 | Nelson et al. | 173/169 X |

*Primary Examiner*—Gerald A. Michalsky
*Attorney, Agent, or Firm*—Walter C. Vliet

[57] ABSTRACT

A device for retaining a depressed reversing valve in the depressed position which is operable by the fingers or thumb of one hand to accomplish both the depressing and locking motions and the unlocking motion when it is desired to return the tool to conventional push to reverse operation. This is accomplished by a notched rotary sleeve mounted to the tool housing.

8 Claims, 1 Drawing Sheet

SELECTION SWITCH FOR FLUID POWER MOTORS

This application is a Continuation of application Ser. No. 07/615,371, filed Nov. 19, 1990, now abandoned.

BACKGROUND OF THE INVENTION

This invention relates generally to operative selector switches for fluid power motor output direction and the like, and more particularly to a convenient one-hand operative selector switch for reversing motor directions of a fluid power motor.

Reversing a fluid power motor's output rotation is usually done with a valve which reverses the supply and discharge of the motor. The designs of the valving to accomplish the reversing of fluid power flows are many.

The one known prior art design that has two different modes of either one cycle or many cycles of reversed rotation is a reverse valve with a push-down valve for one cycle operation and with a push-down and twist-to-lock motion for many cycle operations. The major disadvantages of this design is the awkward push-down and twist motion required to lock and unlock the valve in the reversed many cycle mode of operation.

The foregoing illustrates limitations known to exist in present fluid power operated tools. Thus, it is apparent that it would be advantageous to provide an alternative directed to overcoming the limitation set forth above. Accordingly, a suitable alternative is provided including features more fully disclosed hereinafter.

SUMMARY OF THE INVENTION

In one aspect of the present invention, this is accomplished by providing a selector switch for fluid power motor disposed in a handle comprising a plunger operatively connected to a switching element resiliently biased in a first direction outward of the handle in a first selected position and a means for restraining the plunger in a second direction inward of the handle in a second selected position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
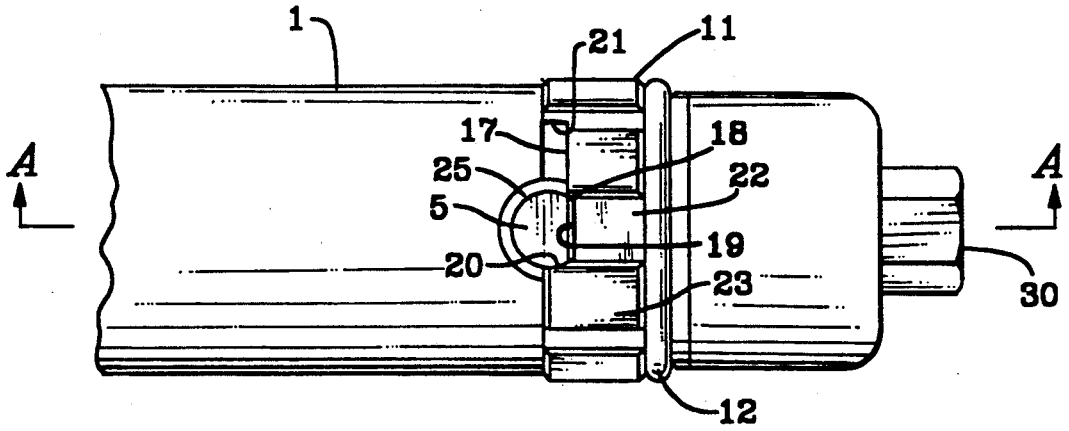
FIG. 1 is a plan view illustrating an embodiment of the selector switch of the present invention.

FIG. 1 shows the handle portion of a typical fluid power driven tool such as a push to start screwdriver generally indicated by reference numeral 1. The handle or housing 1 is provided with a fluid power inlet 30 which is typically a threaded connection for receiving an air hose having a threaded coupling end (not shown). Shown mounted on the housing surface is a rotatable sleeve 11 which is positioned for rotation about the housing by means of a housing step or stop 13 (best seen on FIG. 2) and a retaining ring 12. The rotatable sleeve 11 partially intersects a cross bore 32. The cross bore accepts a pressed in bushing 2 having an inlet port 3, a forward outlet port 7, and a reverse outlet port 8 mating with aligned holes in housing 1. Inserted in the bushing 2 is a reverse valve element 5 provided with a reverse port hole 24 and a porting slot 16.

Figure 2:
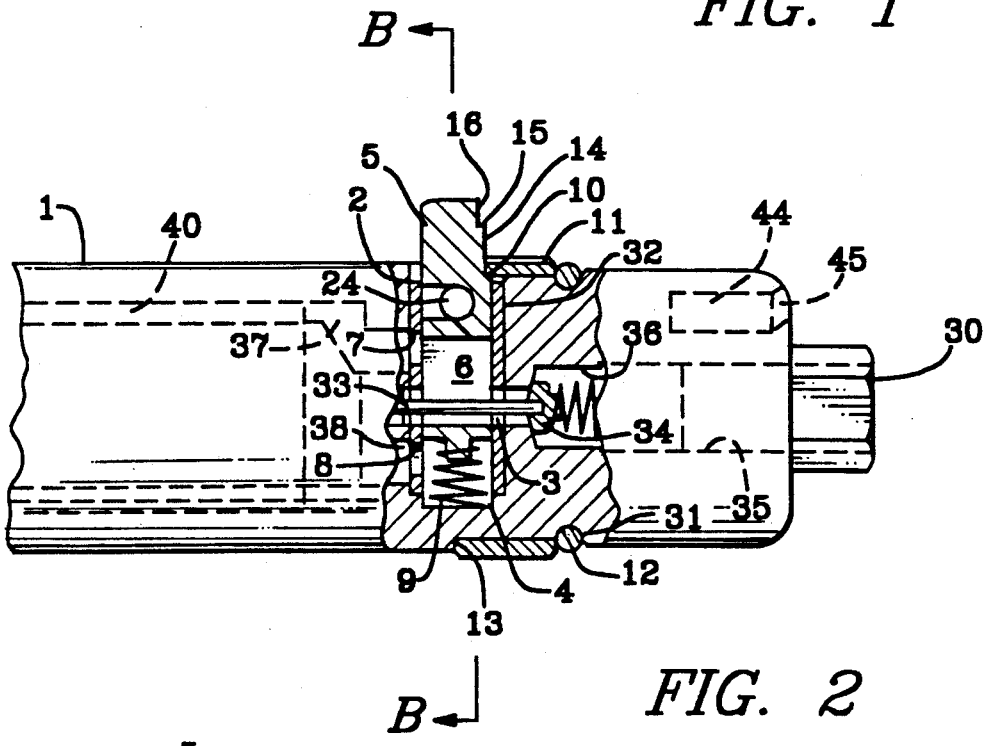
FIG. 2 is a cross-sectional side view taken about Section A—A illustrating an embodiment of the selector switch of the present invention.

As seen in FIG. 2, the inserted reverse valve element forms an enclosed spring chamber 4 between the valve element 5, the bushing or sleeve 2, and the housing 1. A spring 9 is inserted in the chamber to bias the valve element outward to the forward operating position. In typical push to start screwdrivers the actuating rod 33 displaces an on-off valve element 34 to the left as shown in FIG. 2, thereby permitting pneumatic fluid to enter from inlet 30 through inlet passageways 35 and 36 to inlet port 3. The pneumatic fluid passes through port slot 6 in the valve element 5 and exits through forward port 7 and thereafter through passageway 37 to be distributed to drive pneumatic motor 40 which in turn drives the screwdriver in a manner well known in the art.

When the valve element 5 is depressed against spring 9 the port slot 6 is shifted so as to now direct the incoming pressure fluid through reverse port 8 and passage 38 to drive the motor 40 in reverse. In the forward driving direction, pressure fluid exhausted from the motor 40 is directed back through passage 38 into the lower set of exhaust ports 26 (missing) and 27 best seen in FIG. 3.

Figure 3:
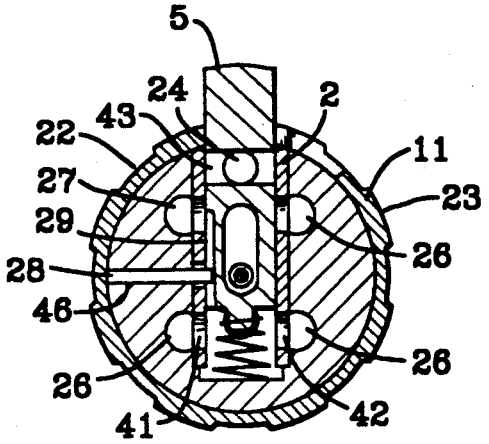
FIG. 3 is an end sectional view of the selector switch of the present invention taken about section B—B.

Exhaust ports 41 and 42 are provided in the bushing 2 for this purpose as best seen in FIG. 3. In reverse operation, the depressed reverse valve receives exhaust fluid through the forward port 7 and it is distributed by means of valve port 24 by means of an intersecting cross port 43 to the upper set of exhaust ports 26 and 27. The exhaust ports 26 and 27 direct the exhausted pressure fluid to a muffler 44 at the back of the tool and ultimately exhaust to atmosphere through exhaust port 45. A pin 28 inserted in a radial bore 46, best seen in FIG. 3, is utilized to retain the bushing 2 in cross bore 32 and to orient the reverse valve element 5 in the bushing bore.

With the exception of the modified reverse valve element and the rotary sleeve 11 the previously described elements are well-known in the prior art. As previously stated, the unique sleeve of the present invention cooperates with the reverse valve element 5 to provide a means for retaining the reverse valve in the reverse position. The arrangement of parts permits the valve to be depressed and locking means to be activated with one finger or thumb with two combined motions. Likewise, only one finger or thumb with one motion is required to disengage the locking device, thus allowing the spring biased reverse valve to return to the manual operation mode.

Housing step 13 and retaining ring 12 cooperate to position sleeve 11 in the proper location and permit its rotation. As previously stated, pin 28, shown in FIG. 3, provides a close control guide means in slot 29 of valve element 5 to maintain porting alignment and prevent rotational misalignment of valve face 16 and sleeve edge 17.

In the conventional operating mode position shown in FIG. 1, the tool may be repeatedly driven in forward and reverse by simply depressing the valve element 5 when reverse operation is required. According to the present invention if the operator wishes to lock the tool in the reverse operation mode it is simply necessary to depress the valve element 5 and to rotate the sleeve 11 in a counterclockwise direction as viewed in FIG. 3.

In the conventional operating mode, face 14 on valve 5 is in close proximity with surface 19 on sleeve 11. Likewise, the notch edges 18 and 20 are in close proximity with circumference 25 of valve 5. This relationship of mating surfaces assists in proper alignment of the porting passageway and provides a stop means for the valve when in the totally manually control mode. To lock a valve in the reverse mode, valve 5 is depressed into the housing 1 and bushing 2. The groove 22 and lug 23 on sleeve 11 are positioned with valve 5 to allow a finger or a thumb to be automatically engaged when the valve is depressed. The finger or thumb can be moved sideways to rotate sleeve 11 wherein edge 17 moves over step 15 on valve 5 and into close proximity with surface 16. Edge 21 on sleeve 11 acts as a stop against valve circumference 25. The operator now removes his finger or thumb and the reverse valve is mechanically held down.

To disengage the sleeve 11 from step 15 on reverse valve 5, the operator can engage any slot like 22 with a finger or thumb and rotate the sleeve 11 until edges 18, 19, and 20 are realigned with similar surfaces on valve 5. The bias's spring 9 will push the valve out of the housing until step 5 reengages the overhang of sleeve 11. The reverse valve is now again in the conventional operating mode.

While the preferred design is shown with a rotational movement to engage or disengage the locking mode, other movements such as a linear movement parallel to the tool centerline may be beneficial and could be accomplished in the spirit of the two steps 10 and 15 on valve 5 engaging with the inside diameter of sleeve 11.

Having described the invention, what is claimed is:

1. A selector switch for a fluid power motor disposed in a total comprising:

an exposed switch operating plunger being provided with complimentary step lands operatively connected to a switching element resiliently biased in a first direction outward of a mounting surface on said tool in a first selected position of said plunger and said switching element;

a means for selectively restraining said plunger and said switching element in a second direction inward of said mounting surface in a second selected position; and said means for selectively restraining said plunger further comprises a rotary sleeve element mounted for rotation about and in sliding surface contact with said mounting surface about a circle partially intersecting said plunger selectively at said complimentary step lands for selectively retaining said plunger in selectively depressed positions.

2. A selector switch for a fluid power motor according to claim 1 wherein said rotary element is provided with a notch permitting extension of said plunger in one position of said rotary element and said rotary element restrains said plunger in said second selected and depressed position in another rotary position.

3. A selector switch for a fluid power motor according to claim 2 wherein said notch retains said plunger within said mounting surface in said first selected position while permitting said plunger to extend outward from said mounting surface in said another rotary position, and a biasing means is provided to urge said plunger to extend outward.

4. A selector switch for a fluid power motor according to claim 1 wherein said rotary sleeve element is mounted on said mounting surface in a circumferential land having a fixed stop at one end to set its rotary position and a removable stop at its other end to permit axial assembly and positioning of said rotary element, and said mounting surface forms a substantially circular handle for positioning said motor in the form of a work producing tool.

5. A selector switch for a fluid power motor according to claim 4 wherein said rotary element is provided with alternate lugs and grooves on its exterior surface to permit ready rotation of said rotary element to position a notch in said rotary element relative to said plunger.

6. A retaining means for a selector switch comprising:

an exposed switch operating plunger being provided with complimentary steps projecting from a handle; and a sleeve mounted for rotation about said handle said sleeve being provided with a notch which cooperates with said complimentary steps on said plunger whereby in selected positions of said sleeve said plunger is retained at selected hand set levels to accomplish selected functions, said functions being selected by simultaneously depressing said plunger and rotating said sleeve or conversely releasing said plunger by rotating said sleeve.

7. A retaining means according to claim 6 wherein said plunger further comprises a reverse valve for a fluid power tool.

8. A retaining means according to claim 7 wherein said power tool comprises a pneumatic screwdriver.

* * * * *